US005850718A

United States Patent [19]

MacKarvich

[11] Patent Number: 5,850,718

[45] Date of Patent: Dec. 22, 1998

[54] FOUNDATION FOR MANUFACTURED HOME

[76] Inventor: Charles J. MacKarvich, 1720 Tyler Green Trail, Smyrna, Ga. 30080

[21] Appl. No.: 739,717

[22] Filed: Oct. 29, 1996

Related U.S. Application Data

[63] Continuation-in-part of Ser. No. 644,069, May 9, 1996, which is a continuation-in-part of Ser. No. 629,834, Apr. 10, 1996.

[51] Int. Cl.[6] ..... E02D 27/00

[52] U.S. Cl. ..... 52/292; 52/DIG. 11; 52/695

[58] Field of Search ..... 52/169.9, DIG. 11, 52/23, 148, 146, 299, 155, 156, 157, 292

[56] References Cited

U.S. PATENT DOCUMENTS

| | | | |
|---|---|---|---|
| 3,750,349 | 8/1973 | Deike | 52/292 X |
| 3,830,024 | 8/1974 | Warnke | 52/126 X |
| 3,845,597 | 11/1974 | Foster | 52/166 |
| 4,261,149 | 4/1981 | Gustafson | 52/292 |

*Primary Examiner*—Creighton Smith

*Attorney, Agent, or Firm*—Thomas, Kayden, Horstemeyer & Risley

[57] ABSTRACT

Stabilizer bars (28) and (30) extend across the lengths of the I-beam joists (12) and (14), beneath the piers (16) and (18). Tie down anchors (32) and (34) are placed in abutment with the outer ends of the stabilizer bars, so that the anchors cannot be pulled and bent toward the manufactured home due to the forces in the anchor ties (101) and (110). Tie down shoes (50) and (51) are mounted at the lower portions of the piers (16) and (18), and ties (101, 102, 104, 106, 108, 110) are connected to the tie down shoes so as to increase the resistance of the manufactured home (11) from shifting laterally and from lifting off the foundation.

16 Claims, 10 Drawing Sheets

FOUNDATION FOR MANUFACTURED HOME

CROSS REFERENCE

This is a continuation-in-part of U.S. patent application Ser. No. 08/644,069, filed May 9, 1996, which is a continuation-in-part of U.S. patent application Ser. No. 08/629,834, filed Apr. 10, 1996.

FIELD OF THE INVENTION

This invention relates to a foundation for a manufactured home which rests above the ground on piers. Anchors which penetrate the ground are connected by ties to the lower portion of the frame of the manufactured home, holding the home on the piers. In another aspect, the invention relates to an anchor-less foundation system for use in areas where winds do not exceed about 80 MPH.

BACKGROUND OF THE INVENTION

Manufactured homes, such as mobile homes, trailers, prefabricated houses, and the like are manufactured at a central manufacturing site, and upon completion the homes are moved to a location where they are to be permanently located and occupied. Because these homes are designed to be easily moved from the manufacturing site to the permanent location, they are not originally built on a permanent foundation at the manufacturing site, but on a pair of parallel I-beam joists, and then the manufactured home is transported to and mounted upon piers, such as concrete blocks, pilings or stabilizing jacks, at a site where the home will be occupied. It is important that the home also be anchored in position on the piers, with the use of soil anchors and ties extending from the anchors to the framework of the home, so as to avoid the home being shifted off of its piers by strong winds or earth tremors. If a home is inadvertently shifted off of its piers, this can cause serious damage to the home and also can cause human injury.

Various types of stabilizing devices have been used to stabilize the manufactured homes, to keep the homes from moving in response to wind forces and earth movement, such as guy wires, straps or other ties which connect the home to anchors or ground fixtures. A traditional approach to providing wind protection for manufactured homes consists of an anchor having a shaft with one or more helical plates at the bottom of the shaft which can be rotated to move into the earth, and cold-rolled steel strapping installed as diagonal ties between the upper exposed portion of the anchor and the lower main frame of the manufactured home. A system of this type is taught in U.S. Pat. No. 3,747,288. In addition, vertical or "over-the-top" ties may be installed in case of single-wide structures.

The vertical support for manufactured homes usually is provided by piers, such as concrete masonry piers or prefabricated steel piers or precast concrete jack stands located under the parallel joists of the main frame of the manufactured home, with the vertical supports being spaced longitudinally along the parallel joists at approximately 8' from one another.

The soil anchors usually are installed vertically or even with a slight back angle just inside the perimeter of the home. The portion of the anchor shaft of a typical soil anchor which is beneath and adjacent the surface of the soil has a relatively small surface area that contacts the soil. When the upper end of the anchor shaft is pulled laterally by a manufactured home being pushed by the wind, the upper portion of the anchor shaft usually is met with only small soil resistance, and the upper portion of the shaft tends to move through the soil and bend toward the manufactured home, allowing the home to move. Once the anchor has become bent toward the home, its resistance to horizontal movement increases.

One way of increasing resistance to the movement of the upper shaft portions of soil anchors without bending the anchors has been to drive a large stabilizer plate into the soil adjacent the anchor and between the anchor and its home, so that when the upper portion of the anchor is pulled by the tie toward the manufactured home, the anchor engages the stabilizer plate and the pulling force applied by the tie to the anchor is spread over a larger area in the soil.

Another way of increasing the resistance of the upper shaft portions of the soil anchors is to preload the anchor, by deliberately bending the upper end of the anchor shaft toward the home when the anchor is first installed so that the bending of the shaft will have been accomplished prior to the lateral forces being applied by the wind to the house.

Test data for this type of installation have been developed, and the performance of traditional anchor systems have been reviewed. It was shown that the load capacity and stiffniess of helix-plate soil anchors generally are far less than what is required to provide adequate resistance against the loads resulting from wind storms and acting on the diagonal ties and the piers.

Based on extensive laboratory and field studies, the expectations for the performance of traditional anchoring systems are higher than the actual levels of resistance that the anchoring systems can reasonably be expected to provide.

The large horizontal displacements required to bend the anchors and therefore develop acceptable levels of anchor resistance are incompatible with the much shorter horizontal displacement limits of the home which are needed to insure pier stability to support the home.

Stabilizer plates and similar devices which are installed adjacent the head of a soil anchor exhibit low resistance and high variability to anchor head movement which makes them minimally effective for increasing the lateral resistance of soil anchors.

The U.S. Department of Commerce, Department of Housing and Urban Development released a report, NISTIR 5664 entitled "Recommended Performance-Based Criteria for the Design of Manufactured Home Foundation Systems to Resist Wind and Seismic Loads,"(August 1995). This report recommends that preloaded soil anchors be used. By preloading it is meant that the anchor is bent prior to use in the direction of the manufactured home until it resists a certain amount of force, typically 3,000 lbs. The tie extending between the anchor head and the lower frame of the home is then tightened. In particular, the pre-loading can produce a significant increase in anchor stiffness, thus eliminating the need for stabilizer plates and similar devices which have been shown to be somewhat ineffective. The limited test data that are available for cold-rolled steel strapping suggests an in-service ultimate capacity of about 16.9 kN (3,800 lbf). The factored diagonal tie load for a basic wind speed of 44.7 m/s (100 mph) is 7.55 kN/m (518 lbf/ft), resulting in a maximum anchor spacing of 2.24 m (7.3 ft). However, at higher wind speeds the anchor spacing becomes so small that the cones of influence of the helix plate in the soil begin to overlap. Therefore, even with preloading, the traditional shallow anchor/tie/pier system is limited in application to basic wind speeds less than about 44.7 m/s (100 mph).

A particular condition often occurs when double section ("doublewide") manufactured homes are exposed to high winds. These homes comprise two sections that each have an open side. The sides are complementary so that they can be placed together to form a double wide home. The connection point or seal is commonly referred to as the "marriage wall" of the home and it is a weak spot in the home construction. During periods of high wind loading on the home the two sections will attempt to separate and this seal has a tendency to come apart. Present day manufactured home foundation systems do not provide effective means to adequately prevent this separation from occurring.

Traditional soil anchors are sometimes affected by frost heave. During periods of below freezing weather, the ground will heave or expand by as much as three to four inches, depending upon the moisture content of the soil and the temperature of the ground. This can disrupt the placement of the anchor and also cover the tensioning head, disrupting attachment of the connecting straps to the tensioning head.

What is needed, but apparently is not available, is a foundation stabilizing system for manufactured homes that provides improved resistance to horizontal movement as well as resistance to vertical displacement of the traditional soil anchor. What is also needed is an alternative to the traditional soil anchor in a manufactured home foundation system.

SUMMARY OF THE INVENTION

Briefly described, the present invention comprises a foundation for a manufactured home of the type that is mounted on support columns including piers, wherein the piers are supported by the ground and usually are arranged in pairs with the piers of each pair being aligned across the length of the home. The I-beam joists of the home are parallel to each other and extend along the length of the home and form part of the framework of the home. The I-beam joists rest on the pairs of piers positioned beneath the home, with the piers usually bearing the full weight of the home. In the situation where two home units or sections are placed side by side to form a "double-wide" structure, there usually will be separate pairs of I-beams and piers for each home unit.

In one aspect, the stabilizing foundation system includes soil anchors inserted into the ground at the side edge of the home and aligned with the pairs of piers to form an anchor-piers-anchor alignage. Outer stabilizer bars are positioned on the ground and extend between and abut the anchors and their adjacent piers. Ties connect the anchors to the lower frame of the manufactured home. Therefore, the anchor which penetrates the soil, a tie extending between the head of the anchor to the frame of the home, a pier supporting the home, a stabilizer bar having its ends in abutment with the anchor and the pier, and the weight of the home bearing upon the pier, all act in combination to resist movement of the home. The lateral force of the wind blowing against the home is resisted by the anchor and the tie, and the forces on the anchor applied by the tie are partially transferred by the stabilizer bar to the pier and movement of the stabilizer bar is resisted by the pier.

In one embodiment of the invention, tie down shoes are positioned at the lower end of the piers and ties are connected to the tie down shoes and extend upwardly from the shoes over the I-beam joists of the framework of the home, and to an anchor or to another tie down shoe of the adjacent pier. The use of the tie down shoe and its ties assist in holding the home down in opposition to the lifting forces applied by the winds to the home, and resists lateral displacement of the piers from one another and from the associated anchors, and resists lateral displacement of the manufactured home.

If desired, an intermediate stabilizer bar can be placed between the piers of a pair of piers so as to further resist the piers moving toward one another in response to wind forces and to transfer some of the lateral forces applied by the wind to the leeward anchor.

One result of this structure is that the lateral wind forces applied to the manufactured home tend to increase the effective weight of the manufactured home on the piers beneath the home. The ties that extend from the anchors to the I-beam joists of the home and the ties that extend between the tie down shoes and the I-beam joists of the home are sloped upwardly from the anchors and tie down shoes so that when the lateral forces applied by the wind to the home tend to tighten the inclined ties, the angles of the ties cause the ties to pull the lower frame of the home downwardly against its piers. Further, the stabilizer bar which engages between each anchor and its adjacent pier keeps the anchor from moving toward the home structure, so that significant movement of the I-beam joist of the home structure is substantially avoided.

In another aspect, the invention is a foundation system for a double section manufactured home with each section having separate pairs of I-beams and piers. The foundation system includes groups of piers at spaced intervals along the length of the home, with each group of piers including four piers aligned across the home. An anchor is positioned at the outside of each outside pier. Thus, the alignage of each group of piers is anchor-outer pier-inner pier-inner pier-outer pier-anchor. Outer stabilizer bars are positioned on the ground and extend between and abut the anchors and their adjacent outer piers. Diagonal ties connect the anchors to the lower frame of the manufactured home. An inner stabilizer bar or compression member is positioned on the ground and extends between and abuts the two inner piers. Diagonal ties extend from a tie down bracket at the bottom of each inner pier to the manufactured home at a point over the adjacent inner pier. The constant tensile forces applied through the diagonal ties, along with the inner compression member help maintain the marriage wall.

In another aspect, the invention is a foundation system for manufactured homes that avoids the use of tie down anchors. The system is primarily designed for use in areas where wind loads do not exceed about 80 MPH. The foundation system also includes pairs of piers aligned across the length of the home and a stabilizer or compression bar placed end-to-end between the piers. A stabilizer plate having cleats extending into the ground is placed under each pier. Diagonal ties extend from the bottom of each pier to a point on the manufactured home above the adjacent pier, and extend diagonally to the bottom of the opposed pier. Under a wind load, horizontal movement of the home is resisted by the stabilizer pads and forces are transferred through the compression member and the diagonal ties.

Thus, it is an object of this invention to provide an improved foundation for a manufactured home which stabilizes the home against wind forces and earth movements.

Another object of this invention is to provide a stabilized foundation system for manufactured homes which transfers at least a portion of the lateral wind force exerted upon the home from anchors on the windward side of the home to anchors on the leeward side of the home, thus providing the home with greater resistance to movement.

A further object of this invention is to provide a stabilizing foundation system for manufactured homes that includes tie down shoes positioned at the lower portions of the piers of the home and diagonal ties connected between the tie down shoes, the frame of the home, and either to other tie down shoes or soil anchors, thereby providing increased resistance to lateral shifting of the home in response to lateral wind forces and earth movements.

Another object of this invention is to provide an inexpensive stabilizing foundation system for manufactured homes, utilizing traditional soil anchors, wherein the pull-out forces applied to the anchors are maintained in an approximate vertical direction.

Another object of the invention is to provide a foundation system for manufactured homes that uses both soil anchors and piers which support the home as anchors to which ties are connected for resisting lateral movement and uplift of the home due to wind forces.

Another object of this invention is to provide a foundation system for manufactured homes which provides increased hold-down power to the home.

Another object of this invention is to provide a foundation system for manufactured homes comprised of two adjoined sections wherein separation of the sections is reduced or prevented.

Another object of this invention is to provide a manufactured home foundation system that does not rely upon soil anchors.

Other objects, features and advantages of the present invention will become apparent upon reading the following specification, when taken in conjunction with the accompanying drawings.

DETAILED DESCRIPTION

Figure 1:
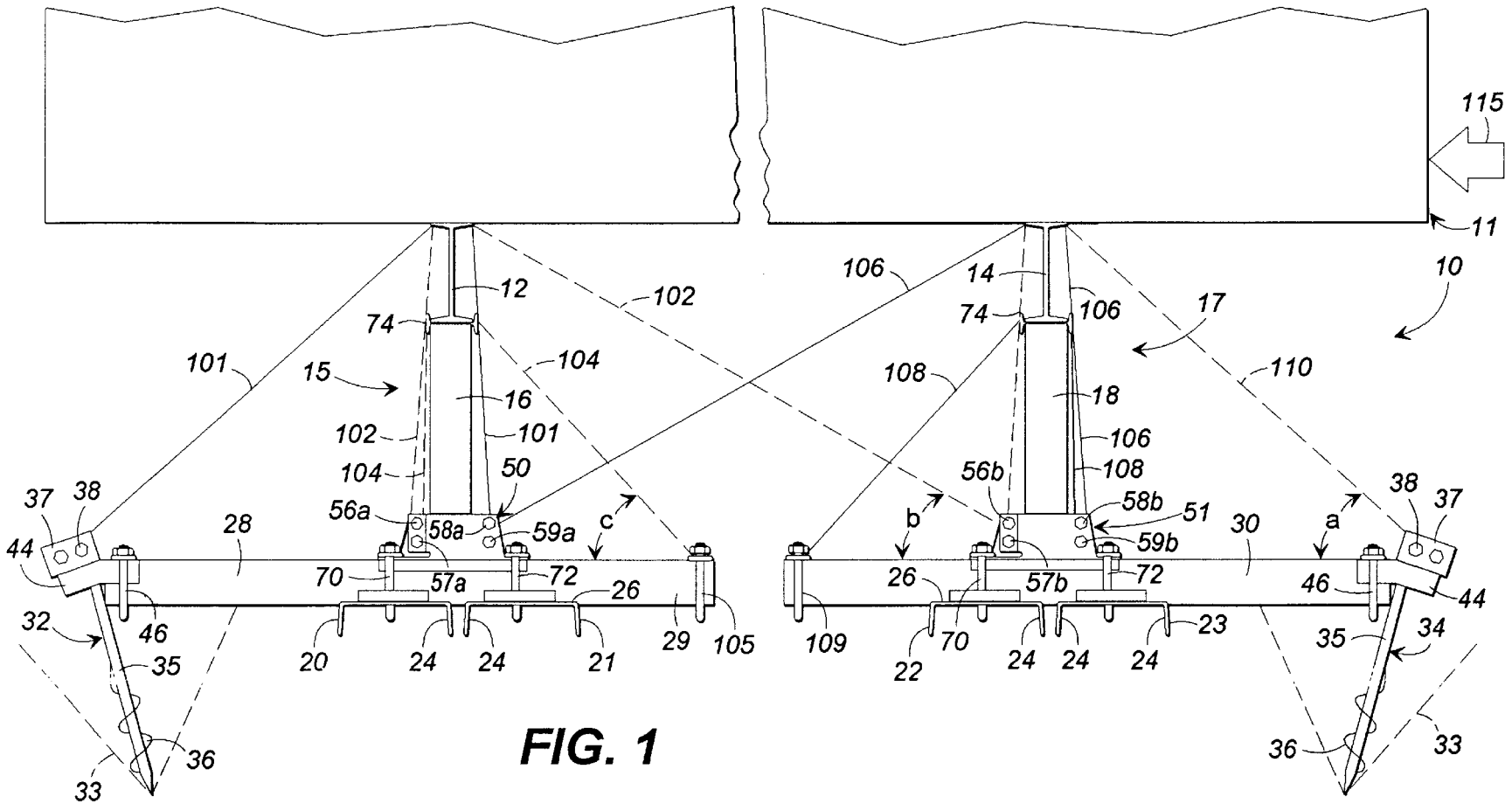
FIG. 1 is a side elevational view of the foundation for a manufactured home.

Referring now in more detail to the drawings, in which like numerals indicate like parts throughout the several views, FIG. 1 illustrates a foundation 10 for supporting a manufactured home 11. The manufactured home is constructed on a pair of parallel, horizontally extending I-beam joists 12 and 14 at a manufacturing site (not shown). After the construction of the manufactured home has been completed, the manufactured home is then transferred to a permanent site illustrated in FIG. 1 where it is to be mounted on support columns 15 and 17, which include piers 16 and 18, where the home will be occupied. The piers 16 and 18 extend upright and can be formed of steel, concrete, wood or other appropriate building material for the geographical site.

When the manufactured home is to be mounted on its foundation, the home typically is placed directly over its site of erection and the foundation is constructed beneath the home, and the home is lowered to rest on its foundation. Cleated support plates 20–23 are placed beneath the I-beam joists 12 and 14 and are aligned with each other across the length of the joists. Typically, there will be a pair of support plates for each pier. The support plates have cleats 24 which extend downwardly from a horizontal platform 26, and the cleats penetrate the ground. The platform 26 of each support plate provides a surface for supporting other elements of the foundation. The cleats inhibit any lateral shifting of the support plates. Stabilizer bars 28 and 30 are placed on the support plates 20–23, with stabilizer bar 28 placed on support plates 20 and 21 and stabilizer bar 30 placed on support plates 22 and 23. The stabilizer bars 28 and 30 extend at a right angle with respect to the lengths of the I-beam joists 12 and 14, and are approximately aligned with each other.

Figure 2:
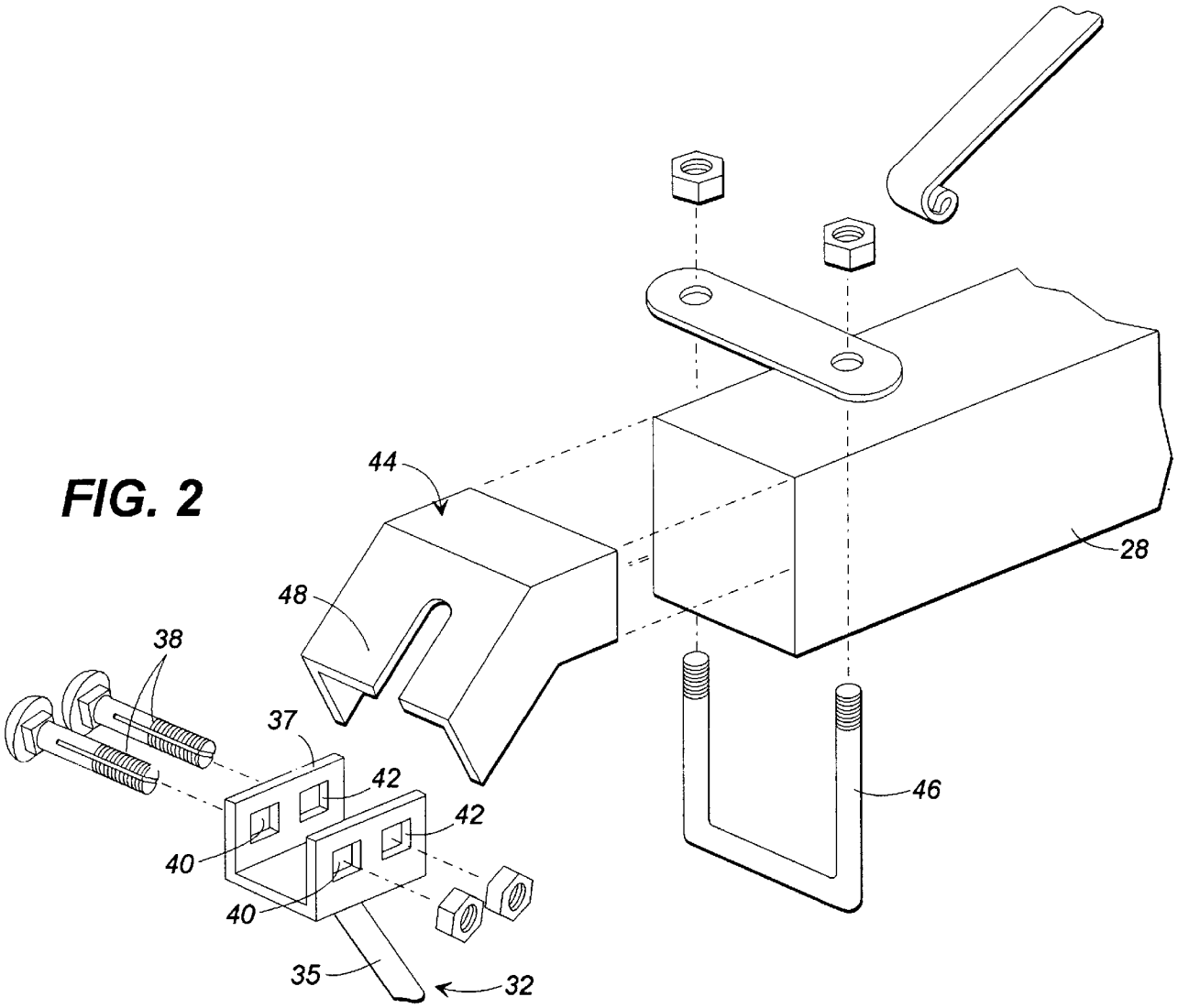
FIG. 2 is an expanded perspective view of the upper portion of a tie down anchor, its anchor bracket, the end of a stabilizer bar and the end of a tie.

Tie down anchors 32 and 34 are inserted in the ground at the outer ends of stabilizer bars 28 and 30, with each tie down anchor including a shaft 35 which penetrates the ground, a helical blade 36 surrounding the lower end of the shaft 35, and a tensioning head 37 rigidly mounted to the upper end of the shaft 35 and positioned above the ground. The tensioning head is approximately U-shaped (FIG. 2), with slotted bolts 38 extending through aligned openings 40, 42 in the tensioning head, so that ties can be inserted at their ends into the slots of the bolts and the bolts rotated to wind the ties about the bolts for tightening the ties. An anchor bracket 44 is mounted at the outer end of each stabilizer bar 28 with a U-bolt 46 rigidly mounting the anchor bracket to the outer end of the stabilizer bar, and orienting the sloped bifurcated skirt 48 of the anchor bracket into engagement with the shaft 35 of the tie down anchor.

As illustrated in FIG. 1, the upright piers 16 and 18 are mounted on and are supported by the lateral stabilizer bars 28 and 30, respectively. The lower ends of the piers 16 and 18 are mounted to the stabilizer bars by tie down shoes 50 and 51, respectively.

Figure 5:
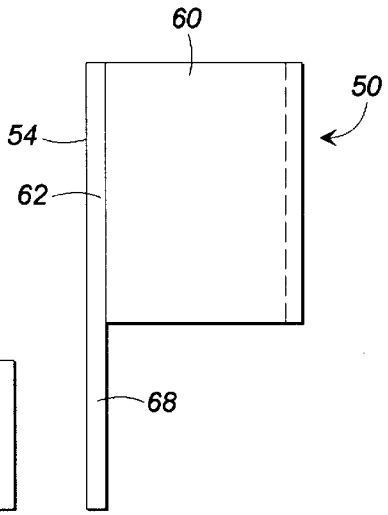
FIG. 5 is an end elevational view of a plate of the tie down shoe of FIG. 3.
Figure 3:
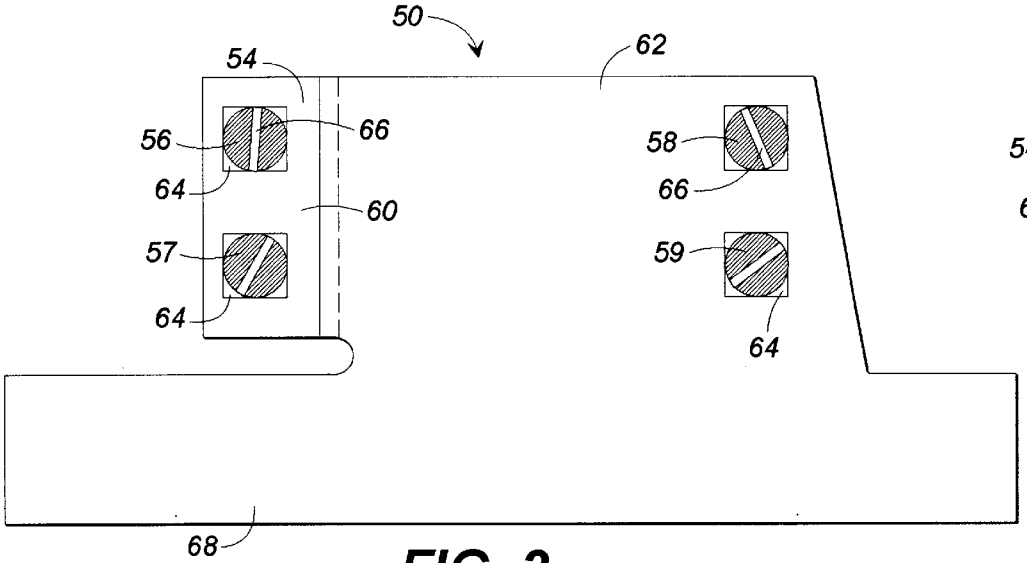
FIG. 3 is a side elevational view of a tie down shoe.
Figure 4:
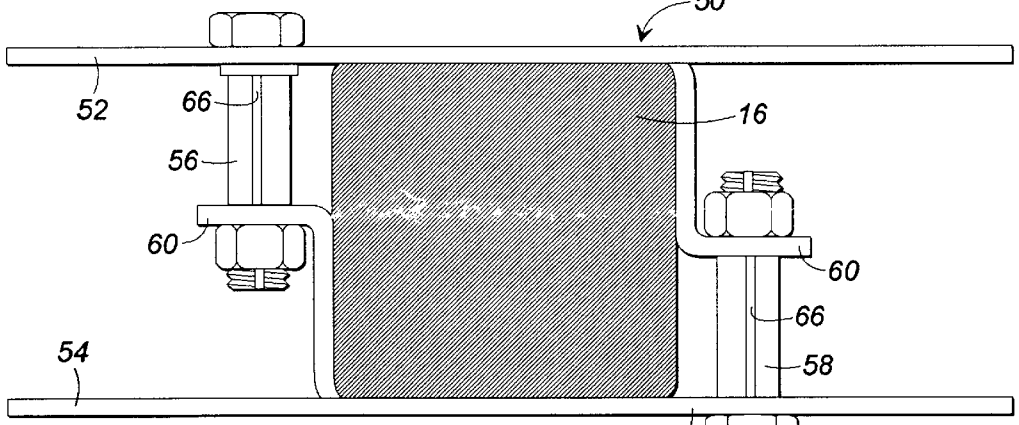
FIG. 4 is a top view of the tie down shoe.

As illustrated in FIGS. 3–5, tie down shoes 50 each comprise a pair of identical plates 52 and 54 which are assembled on opposite sides of the pier 16 and connected together by slotted bolts 56, 57, 58 and 59. The tie down plates 52 and 54 each include an L-shaped connector tab 60 which is offset from the upper body portion 62 of the plate and which defines square bolt receiving openings 64 which are aligned with similar bolt receiving opening of the opposing plate. The portion of the shafts of the bolts adjacent the heads of the bolts are square and are sized so as to fit into the square openings 64, so as to become non-rotatable with respect to the tie down shoes when the bolts are drawn fully into position in the plates by the nuts of the bolts. The slots 66 of the bolts receive the ties of the foundation, and the ties can be spirally wound around the bolts by rotating the bolts before the squared shanks of the bolts are drawn fully into the square openings 64.

The lower body portions 68 of the plates 52 and 54 of the tie down shoes 50 extend beneath and laterally beyond the upper body portions 62. U-bolts 70 and 72 (FIG. 1) connect the ground support plates 20–24 to the protruding ends of the lower body portion 68 of the tie down shoes 50. With this arrangement, the tie down shoes are firmly connected to the stabilizer bars 28 and 30 and to the piers 16 and 18 and to the cleated ground support plates 20–23, thereby firmly connecting the piers 16 and 18 to the stabilizer bars 28 and 30 and to the ground.

Figure 6:
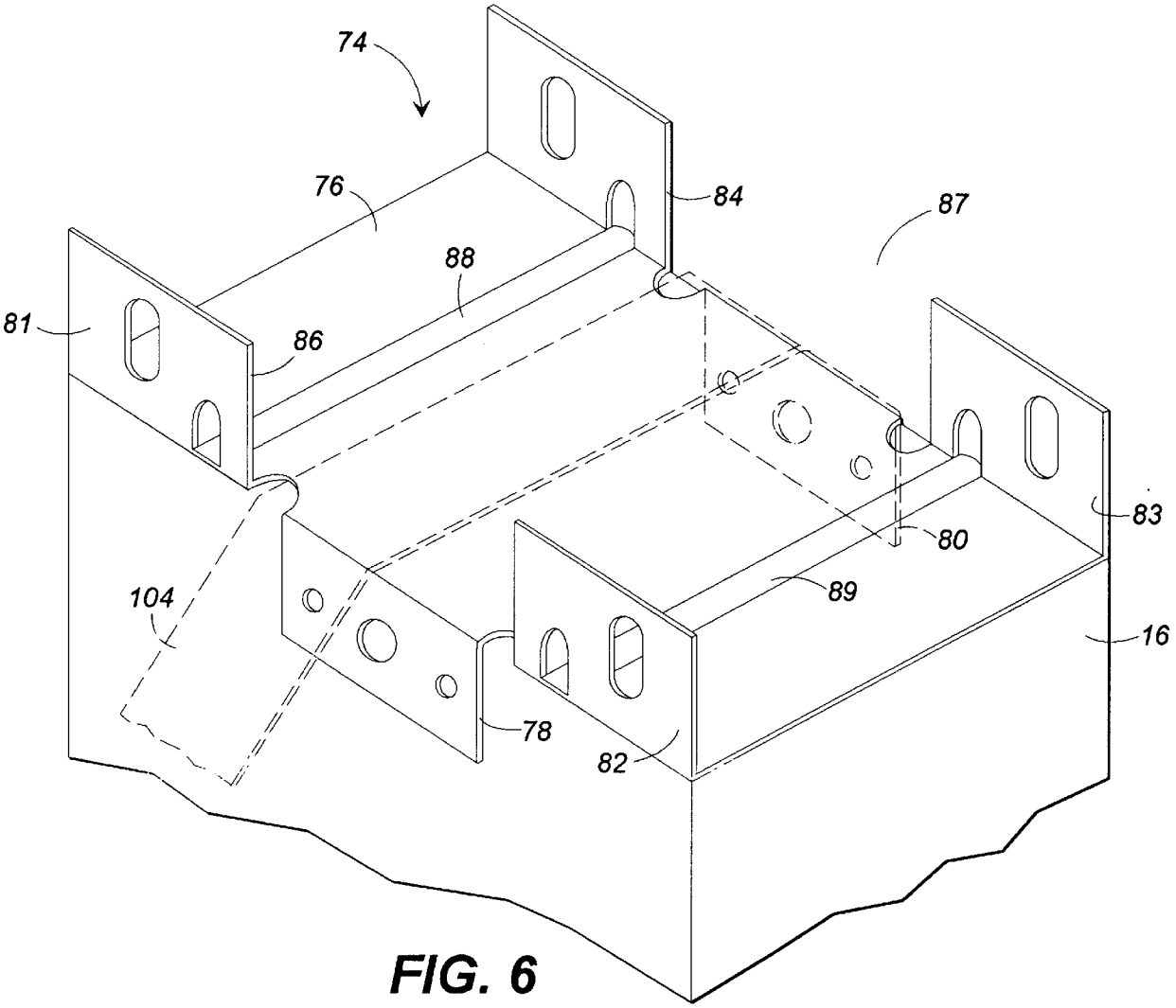
FIG. 6 is a perspective illustration of the pier plate that is mounted between the upper end of a pier and the I-beam joist supported by the pier, showing how the ties pass over the plate, between the upper end of the pier and the joist.

As illustrated in FIG. 1, pier plates 74 are placed on the upper ends of piers 16 and 18, beneath the I-beam joists 12 and 14 of the manufactured home. As illustrated in FIG. 6, the pier plates 74 each include a platform which is placed on top of the pier and beneath the joist, downwardly turned locating tabs 78 and 80 which extend from the intermediate portions of opposite sides of the platform 76, and upwardly turned locating tabs 81, 82, 83 and 84 which are positioned at the ends of the sides of the platform 76, straddling the downwardly turned tabs 78 and 80. This forms slots 86 and 87 above each of the downwardly turned tabs 78 and 80, between the upwardly turned tabs 81–84. Upwardly extending parallel ribs 88 and 89 extend across platform 76 between the upwardly turned locating tabs 81 and 84 and 82 and 83 respectively.

When the I-beam joist 12 or 14 is placed on the pier plate 74, the ribs 88 and 89 maintain a small space between the lower surface of the I-beam joist 12 or 14 and the pier plate, and ties 104, 108 of FIG. I are passed beneath the I-beam joist and over the pier plate.

As illustrated in FIG. 1, a plurality of ties are connected at their ends to the tie down anchors 32 and 34, and to the tie down shoes 50 and 51. In order to distinguish the ties from one another, some of the ties are shown in dash lines.

As illustrated in FIG. 1, anchor tie 101 is connected at one end to tie down anchor 32 and slopes upwardly from the tie down anchor at approximately 45°, and passes over the I-beam joist 12, and then extends downwardly to the tie down shoe 50, where it is connected to the upper bolt 58*a*. The anchor tie 101 is tightened by rotating the slotted bolt 38 (FIG. 2) and locking the bolt in the square-shaped opening of the tensioning head of the anchor.

Shoe tie 102, illustrated in dash lines, is connected at one end to slotted bolt 57*a* of tie down shoe 50 and extends upwardly over I-beam joist 12, and then slopes downwardly to tie down shoe 51 where it is connected at its other end to slotted bolt 57*b* of the tie down shoe 51.

Another shoe tie 104 is connected at one end to slotted bolt 56*a*, extends upwardly over pier 16 and its pier plate 74 and then slopes downwardly for connection at its other end to the extension 29 of the stabilizer bar 28, and is connected there by U-bolt 105.

Shoe tie 106 is connected to slotted bolt 59*a* and is sloped upwardly from tie down shoe 50, extending over I-beam joist 14, and then downwardly from joist 14 and is connected at its lower end to slotted bolt 58*b*.

Shoe tie 108 is connected at one end to U-bolt 109 on extension 31 of stabilizer bar 30, slopes upwardly from U-bolt 109 and passes over pier 18 and its pier plate 74, then extends downwardly for connection to slotted bolt 59*b*.

Anchor tie 110 is connected at one end to tie down anchor 34, and slopes upwardly from the tie down anchor, over I-beam joist 14, and then extends downwardly for connection to slotted bolt 56*b* of tie down shoe 51.

All of the ties 101, 102, 104, 106, 108, and 110 are tightened by rotating their slotted bolts, in a conventional manner.

As shown in FIG. 4, the slotted bolts on opposite sides of the tie down shoes 50 and 51 are offset from each other. This permits the ties to pass each other without intersecting each other. Moreover, as shown in FIG. 6, the slots 86 and 87 of the pier plates are wide enough so as to accommodate ties from either side of the tie down shoes.

When the foundation is assembled and the home is mounted on the foundation as illustrated in FIG. 1, and a force, such as wind force 115 is applied to the manufactured home 11, the following functions will be performed by the foundation. The home 11 tends to shift in the direction of the wind 115, which is from right to left in FIG. 1. The I-beam joists 12 and 14 tend to move with the home. Tie 110 that extends between anchor 34, over I-beam joist 14, and downwardly to the tie down shoe 51 tends to stretch and pull tie down anchor 34 in the direction of the tie, sloped upwardly from the anchor. The left movement of the tie down anchor 34 is resisted by the inherent strength of the anchor being partially buried in the earth, and also resisted by the stabilizer bar 30. Since the dead weight of the home 11 rests on pier 18, and since pier 18 is mounted on the stabilizer bar 30, and since the stabilizer bar 30 is locked by the U-bolts 70 and 72 to the cleated ground support plates 22 and 23, there will be no lateral yielding of the stabilizer bar in response to the forces applied to it by the tie down anchor 34, and therefore the abutment of the anchor against the outer end of the stabilizer bar 30 avoids lateral movement of the tie down anchor 34. Therefore, the lateral movement of the I-beam joist 14 is resisted.

The present invention also provides increased resistance to vertical displacement of the tie down anchors 32 and 34 and therefore avoids lifting of the manufactured home. The stabilizer bars 28 and 30 abut the anchors so as to prevent the anchors from bending toward the piers in response to wind forces applied against the side of the manufactured home. Therefore, the pull-out force on the soil anchors must be applied in an approximate vertical direction, parallel to the shafts of the anchors, the stabilizer bars position the tie down anchors in an effective preloaded geometry. Therefore, the entire cone of influence 33 of each anchor in the soil is utilized in preventing vertical pull-out of the anchor. The present invention allows preloading of the anchors without bending the anchor shafts, which simplifies the installation of the foundation, and which provides a predictable limitation on the potential lateral movement of the tie down anchors in response to wind forces applied to the manufactured home.

Moreover, the invention uses "dynamic forces" of the manufactured home to increase the horizontal support of the home as the wind load increases on the windward side of the home. For example, the sloped anchor ties 101 and 110 resist horizontal movement and vertical movement of the home. As the horizontal wind load increases, downward vertical force applied to the I-beam joists by the sloped tie is increased because of the slope of the ties extending downwardly from the joists back in the direction of the wind. For example, assuming that the angle A between the anchor tie 110 and the horizontal is 45°, a 1000 lb. horizontal force on the anchor tie 110 will generate approximately 700 lb. of downward vertical force on the I-beam joist 14 so as to offset the lifting force applied by the wind. This downward vertical force will increase as the angle of the anchor tie 110 increases. For example, if the anchor tie 110 is connected at 60° from the horizontal, a 1000 lb. horizontal wind load will result in 866 lb. of downward vertical force. This is calculated as: cos 60°×1000 lb=866 lb. Likewise, if the angle B between the shoe tie 102 and the horizontal is 45°, a 1000 lb. horizontal wind load on the shoe tie 102 will result in over 700 lb. of downward vertical force on I-beam joist 12. Of course, in both instances, the dead weight of the home 11 would be added to the downward force.

In the instance where the home 11 tends to slightly shift laterally in response to the wind force 115, pier 16 would be further stabilized by shoe tie 104. For example, if the angle C between the shoe tie 104 and the horizontal is 60°, a 1000 lb. additional tension in shoe tie 104 would result in an additional downward force in the amount of 500 lb. This is calculated as: sin 60°×1000 lb=500 lb.

Stabilizer bars 28 and 30 are anticipated to be of rugged stock, such as 4×4 wooden beams which are suitable for withstanding compression forces applied by the tie down anchors 32 and 34 and by the piers 16 and 18. Therefore, the stabilizer bars function as lateral compression members in resisting the movement of the tie down anchors. Of course, other compression members might be used, such as metal beams, pipes, concrete slabs, and other items suitable to withstand the compressive forces applied by the tie down anchors and the piers and other elements of the foundation.

Figure 7:
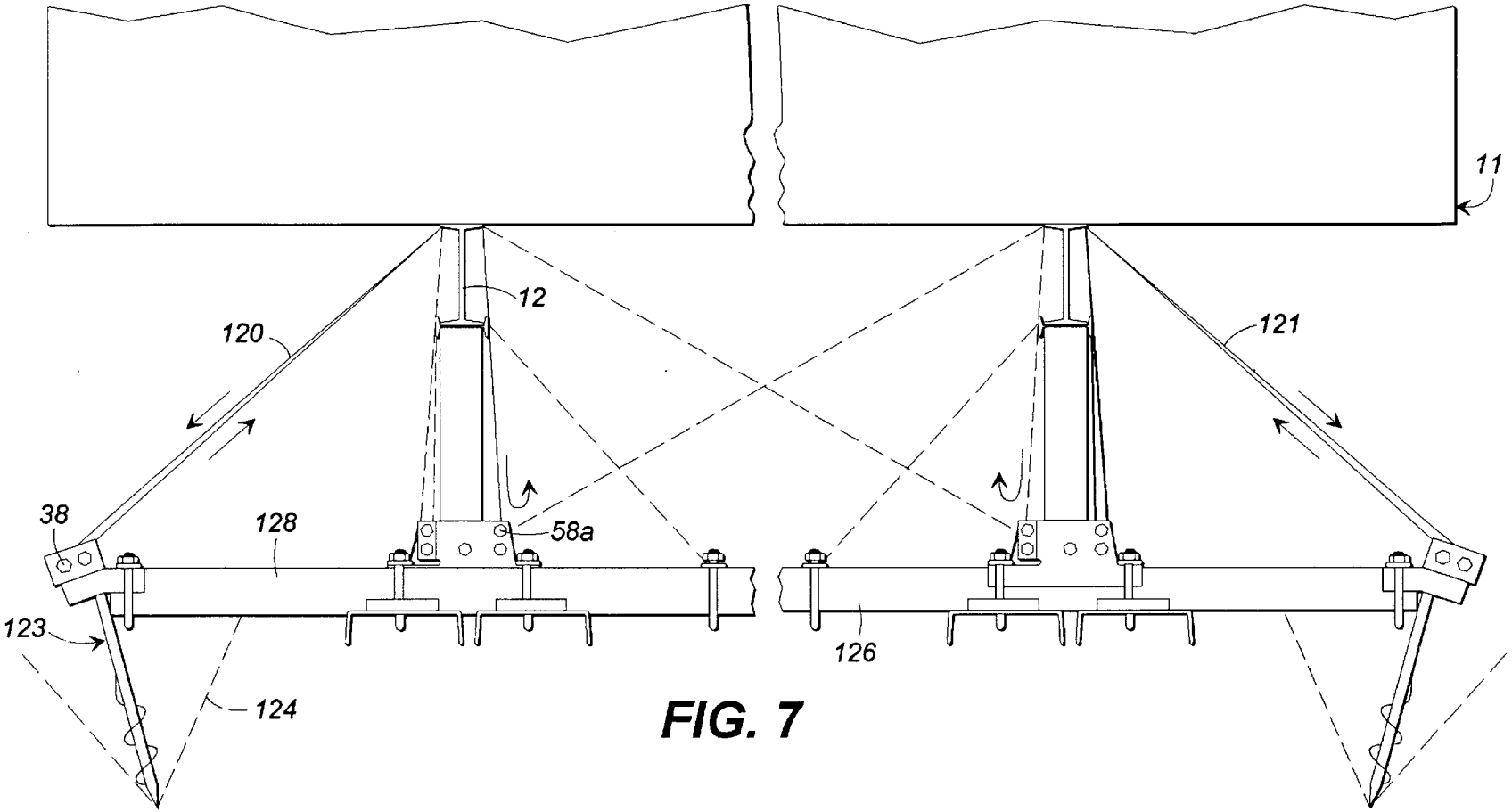
FIG. 7 is a side elevational view, similar to FIG. 1, but showing a double tie connection between the anchors and the tie down shoe.

FIG. 7 demonstrates the use of double anchor ties 120 and 121 in the foundation system. The anchor tie 120 is looped about slotted bolt 58*a*, and it is passed in double lengths over the top of I-beam joist 12, and its ends are fastened in the slots of the slotted bolts 38 of the tie down anchor 123. The doubling of the tie at the anchor 123 allows the tie to withstand substantially twice the load of a single tie. The use of the stabilizer bar 128 to buttress the tie down anchor 123 causes the anchor to increase its resistance to movement without increasing the structure of the anchor. Further, the near vertical attitude of the anchor 123 maximizes the amount of vertical resistance applied through its cone of influence 124.

Another feature of FIG. 7 is that the stabilizer bar 126 can extend completely from one side to the other side of the manufactured home, so that a single stabilizer bar is utilized. Thus, if more lateral forces are applied to one I-beam joist than to the other, the single stabilizer bar will receive substantially all of the lateral shifting forces, so that, for example, the forces applied by the windward anchor to the stabilizer bar will be transmitted directly through the stabilizer bar to the leeward anchor, thereby causing the leeward anchor to resist some of the lateral forces.

Figure 8:
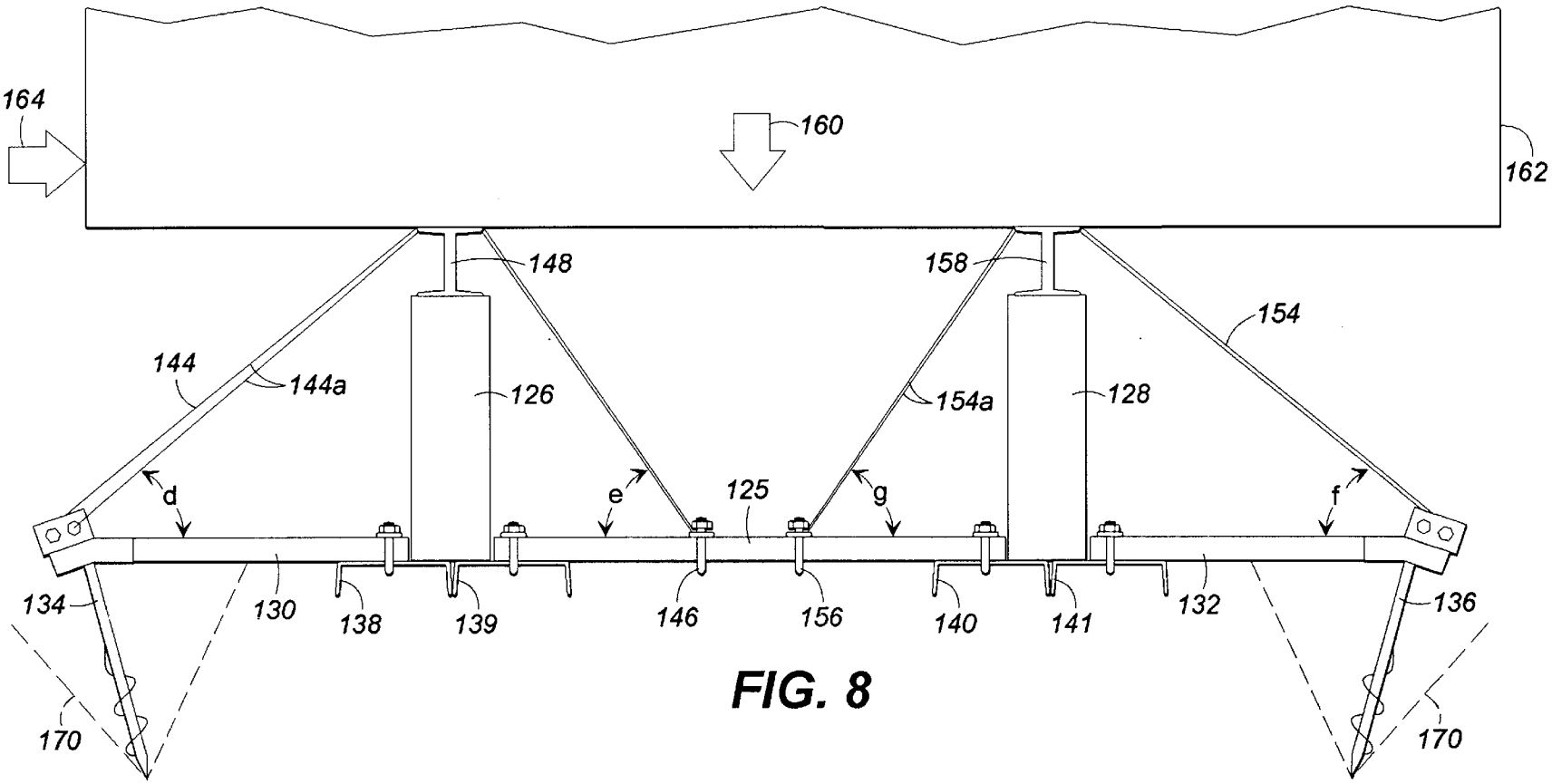
FIG. 8 is a side elevational view of another embodiment of the invention.

FIG. 8 of the drawings illustrates another embodiment of the invention, wherein an intermediate stabilizer bar 125 is positioned in end abutment with piers 126 and 128. Outer stabilizer bars 130 and 132 are in end abutment with piers 126 and 128, and tie down anchors 134 and 136. The ends of the stabilizer bars 125, 130 and 132 which are adjacent piers 126 are connected by U-bolts to the cleated ground support plate 138, 139, 140 and 141. A double anchor tie 144 is connected to intermediate stabilizer bar 125, about a U-bolt clamp 146, and extends up at a sloped angle of approximately 45° upwardly over I-beam joist 148, and then extends at a sloped angle downwardly so that its ends are connected to tie down anchor 134. Preferably, the angles D and E which are formed between the sloped runs of the tie 144 with respect to the horizontal are 45°.

Likewise, the double tie 154 extends from its U-bolt 156 which is rigidly mounted to the intermediate stabilizer bar 125, sloped upwardly over the I-beam joist 158, then slopes downwardly and is connected at its ends to the tie down anchor 136. Again, the preferred angles F and G formed between the sloped runs of the tie 154 and the horizontal are 45°.

In an example of how the foundation of FIG. 8 functions, it will be assumed that a dead vertical load in the amount of 3000 lbs. is applied by the manufactured home 162 to the pair of piers 126 and 128, as indicated by arrow 160. If a wind force in the amount of 6000 lbs. is applied laterally to the home 162 as indicated by arrow 164, the horizontal movement of the home 162 will be restrained by the sloped anchor ties 144 and 154. If angles D and G are the same, the lateral load applied to each of the anchor ties 144 and 154 will be one-half of the 6000 lb. lateral wind force, which is 3000 lbs. for each anchor tie. If angles D and G are both 45°, the force that must be resisted by the ties 144 and 154 will be 4243 lbs. for the double straps, or one-half that for each run of the double straps. This is calculated as: cos 45°=3000 lbs/y. This same calculation applies to anchor tie 154, assuming its angle G is also 45°.

In addition, the wind load of 3000 lbs. for each pier 126 and 128 will result in an additional downward force being asserted by the anchor ties 144 and 154 through the pier 126 in the amount of 2121 lbs. (SIN 45°=x/4243 lbs.). This assists the dead load 160 in retaining the manufactured home 162 on the ground during a wind storm.

As with the previous embodiments of the invention, the stabilizer bars 125, 130 and 132 maintain the tie down anchors 134 and 136 in their originally installed positions, with little likelihood that the anchors will bend toward I-beam joists 148 and 158 under the influence of the pulling forces of anchor ties 144 and 154. Likewise, the U-bolts 146 and 156, being rigidly mounted to intermediate stabilizer bar 125, are immovable along the length of the stabilizer bar, so that the tension applied to the ties 144 and 154 by the rotation of the slotted bolts in the tie down anchors 134 and 136 will not be lost in response to any movement of the manufactured home 162 in response to the wind force 164. The cones of influence 170 will be effective to retain the anchors 134 and 136 in the ground, in spite of the lateral forces being applied to the upper ends of the anchors.

Figure 9:
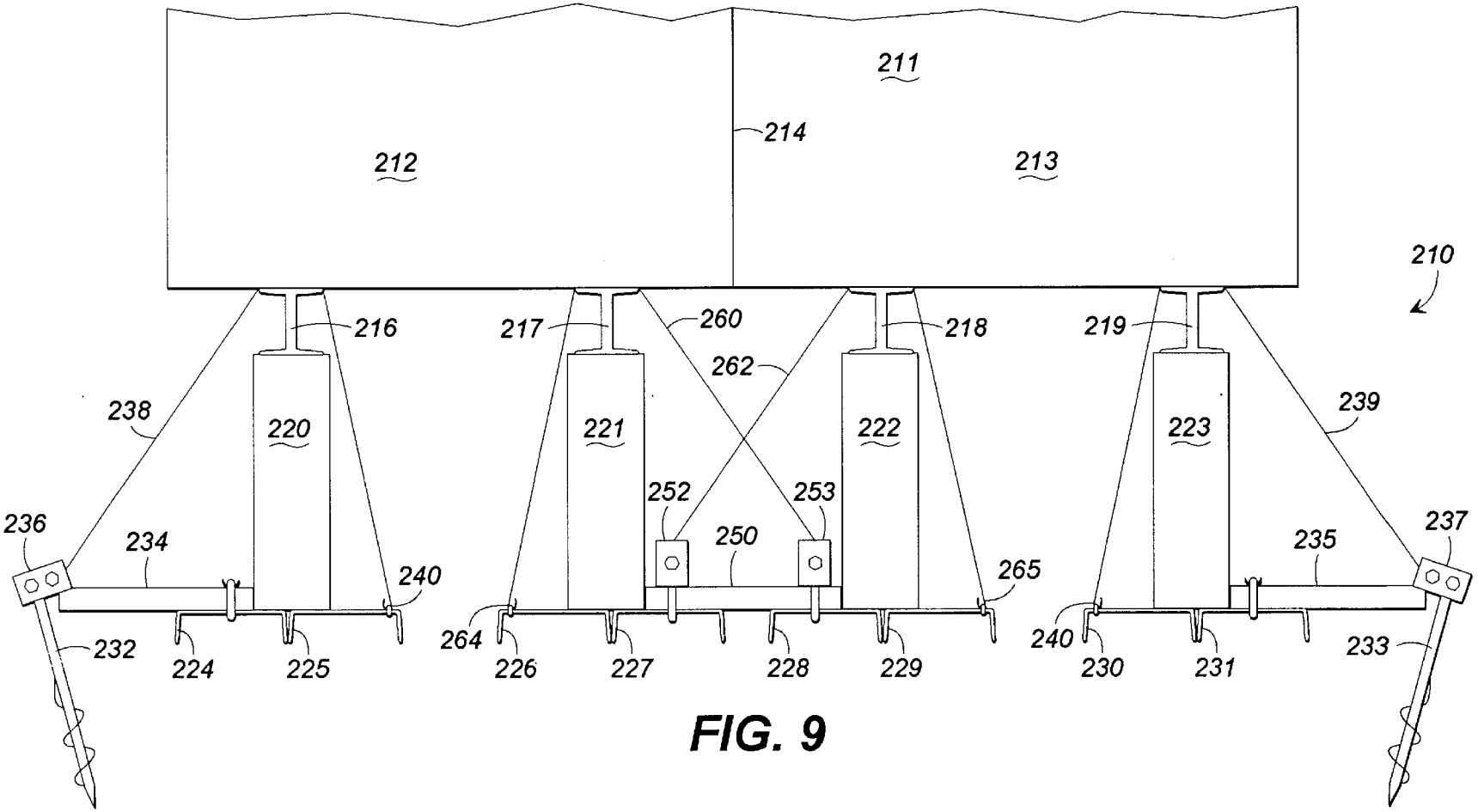
FIG. 9 is a side elevational view of a foundation system for a double section manufactured home.

Another embodiment of a foundation 210 for supporting a manufactured home 211 is shown in FIG. 9. The home of this embodiment is a double section or double wide home having a first section 212 and a second section 213 connected by a marriage wall 214. The manufactured home is constructed on four horizontally extending I-beam joists including outer joists 216 and 219 and inner joists 217 and 218. The joists are supported by a plurality of sets of four piers, outer piers 220 and 223 and inner piers 221 and 222. A pair of support plates are placed beneath each pier, including plates 224 and 225 beneath outer pier 220, plates 226 and 227 beneath inner pier 221, plates 228 and 229 beneath inner pier 222, and plates 230 and 231 beneath outer pier 223. The joists, piers, and support plates are all similar to those described above for other embodiments of the invention.

Figure 10:
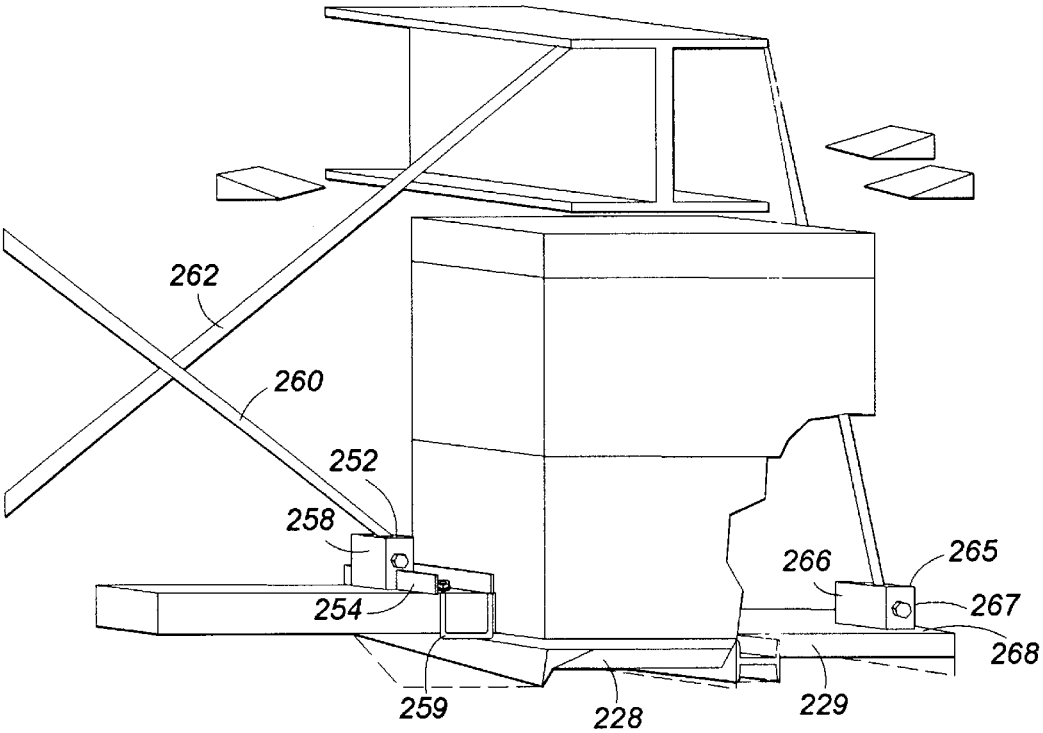
FIG. 10 is a perspective view of a vector tension link tie-down bracket used to fasten one end of a cross-tie in the system of FIG. 9 and a vector tie link used to attach the other end of the cross-tie to a stabilizer plate.

Tie down anchors 232 and 233 are inserted in the ground at the outer ends of stabilizer bars 234 and 235, with the anchors and stabilizer bars positioned as described above. Anchors include tensioning heads 236 and 237. As illustrated in FIG. 9, outer ties 238 and 239 are connected at one of their ends to the tensioning head of tie down anchors 232 and 233, respectively, extend upwardly across the outer joists 216 and 219, respectively, and extend downwardly to the inside lower ends of outer piers 220 and 223, respectively. One end of the tie is fastened in the slot of a carriage or slotted bolt (not shown) of the tie down anchor tensioning head. The other end of the tie is attached to a vector tie link 240 that is structurally the same as tie link 265 (described below) that is better shown in FIG. 10.

The two inner piers 221 and 222 are connected by a central stabilizer bar 250 which is a rectilinear lateral compression member attached to stabilizer plates 227 and 228 by a pair of vector tension links. Tension links 252 are shown more clearly in FIG. 10 and comprise a U-shaped channel 24 interrupted by two generally rectangular plates 256, 258 parallel to each other and perpendicular to the U-shaped channel. A U-bolt 259 has two arms which pass upwards through apertures in the channel 254. A pair of nuts attach over the ends of the U-bolt arms and are tightened to hold an end of the bar 250 to the plate.

A cross tie 260 extends from the outside bottom of pier 221 upwards and over joist 217 and then downwardly diagonally to the inside bottom of pier 222 where it attaches to tension link 253. Another cross tie 262 extends from the outside bottom of pier 222 upwards and over joist 218 and then downwards diagonally to the inside bottom of pier 221 where it attaches to tension link 252. Cross ties 260 and 262 attach at the bottom of piers 221 and 222 by tie links 264, 265. The tie link is a U-shaped plate having two arms 266, 267 and a midsection 268. The tie link is fastened to the support plate 229 by a U-bolt (not shown) having arms that extend upwards through apertures in the plate and apertures in the tie link and is fastened in place with two bolts. A hook on the end of a cross tie attaches to a slot on an arm 266 or 267. Cross ties 260 and 262 attach to tension links 252 and 253 by wrapping into the slot of a carriage bolt (not shown) which extends between the rectangular plates 256, 258.

Foundation system 210 provides increased resistance to vertical displacement of a double wide manufactured home. The system also provides increased resistance to movement or shifting of the marriage wall 214. The outer stabilizer bar and outer ties function similarly to those elements described above for other embodiments. The inner system of cross ties and central stabilizer bar applies constant tensile forces holding the marriage wall together.

In areas of low density soil, additional compression members could be placed between outer pier 220 and inner pier 221 and outer pier 223 and inner pier 222. The ends of the compression members would be held to the stabilizer plates under the piers by being placed under the vector tie links 240, 264, and 265. By so extending the compression bars to be essentially continuous from outside pier to outside pier the far outside leeward pier would become active when the horizontal wind loads are being transferred through the low density soil. Further as the roof of the home experiences uplift due to wind loads, the compression members will offer increased leeward pier support.

Figure 11:
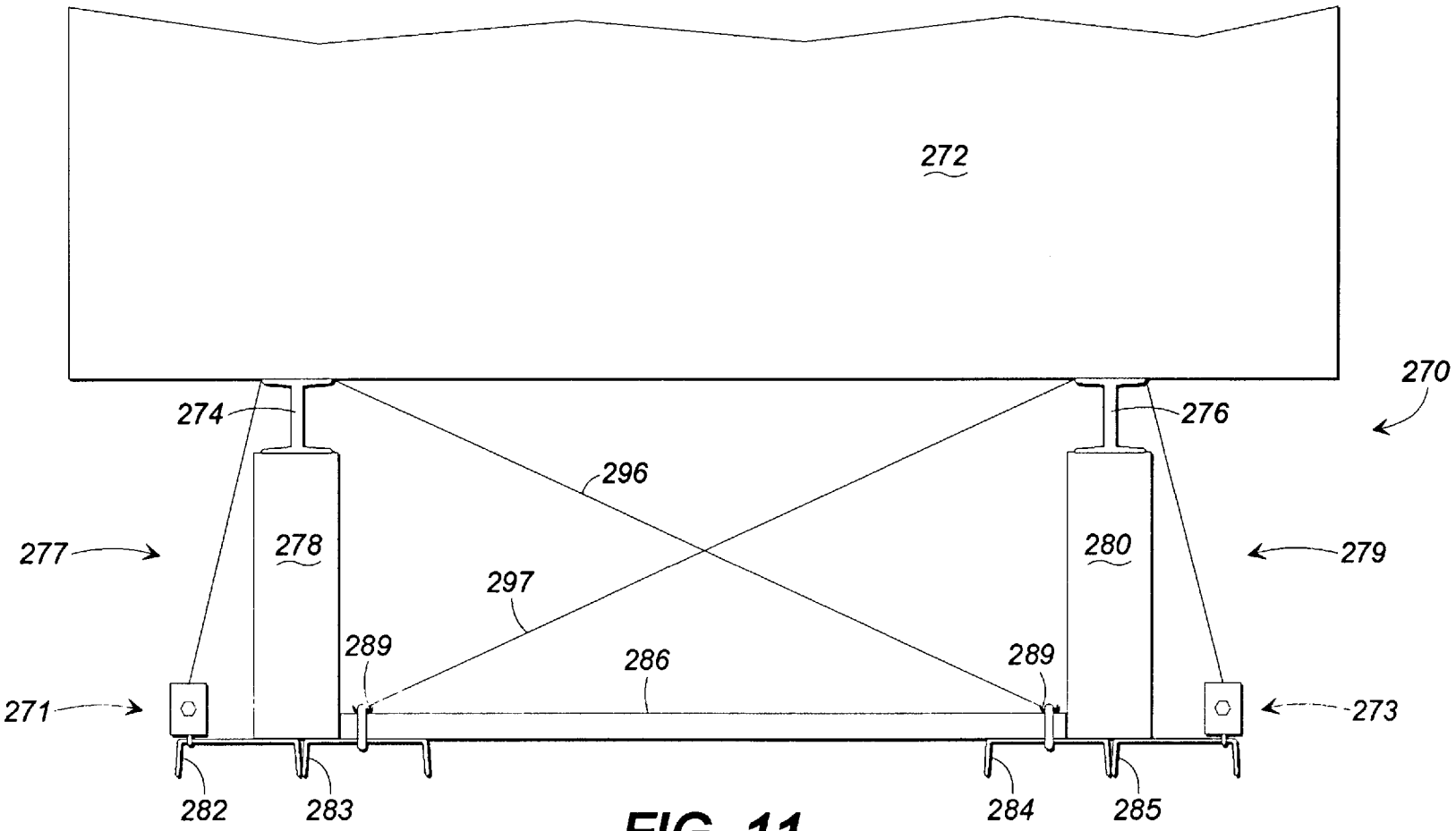
FIG. 11 is a side elevational view of a foundation system that does not rely upon soil anchors.

Another embodiment of a foundation system 270 is illustrated in FIG. 11. This embodiment is designed specifically for use in areas where the wind speed does not exceed 80 MPH. A manufactured home 272, including a pair of joists 274 and 276 is supported by a pair of piers 278 and 280. A pair of stabilizer plates is situated support columns 277 and 279 which include beneath each pier, with plates 282 and 283 beneath pier 278 and plates 284 and 285 beneath pier 280. The stabilizer plates, piers, and joists are similar to or the same as those described above for other embodiments. A central stabilizer bar or rectilinear compression member 286 extends between pier 278 and pier 280. The bar is connected to stabilizer plates 283 and 284 by vector tie links 288 and 289 which are structurally the same as tie link 265 shown in FIG. 10.

Tie links 288 and 289 hold ends of the compression member 286 to the stabilizer plates 283 and 284 and also retain one end of cross ties 296 and 297. Each cross tie extends from a tie link at an upward angle over the joist of the adjacent pier and downward to the bottom of the outside of the adjacent pier. There it attaches to a tension link 298, 299, which are structurally the same as the tension link 252 described above.

It will be noted that foundation system 270 does not incorporate tie down anchors. Thus, the foundation system eliminates problems associated with frost heave. However, the system does provide adequate protection against wind loads up to 80 MPH through the tensioning and wind displacing system of the cross ties and the central compression member.

Figure 12:
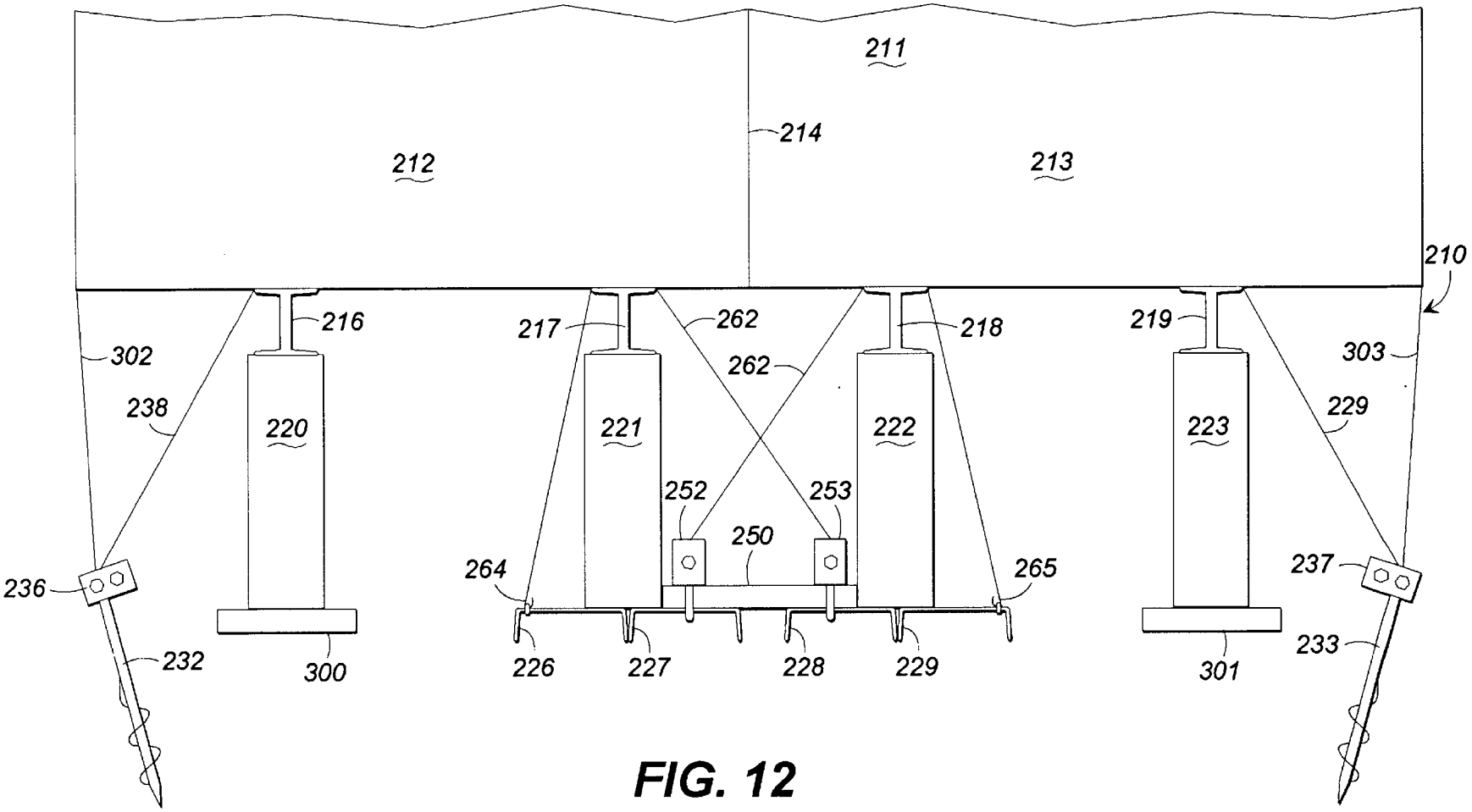
FIG. 12 is a side elevational view of a second embodiment of a foundation system for a manufactured home.

Another embodiment of a foundation system for a double-wide home is illustrated in FIG. 12. This embodiment is designed for areas where the winds may be above 80 mph but below 100 mph. The outside piers, 220, 223 are supported upon pier base pads 300, 301, respectively, that are made of wood, concrete, or plastic, or some other supportive material. The outer stabilizer bars are eliminated and the home is tied down by two additional tie down cables, 302, 303 that are attached to and rise substantially vertically from the anchor tensioning boxes and attach to the home.

In the other embodiments described above, including the embodiment for the double wide home configuration, it should be noted that tie down anchors can be eliminated if the wind loads are expected to be less than 80 MPH. The above illustrated foundation structures should provide sufficient transfer of forces to the leeward piers to prevent movement of the home.

While preferred embodiments of the invention have been disclosed in detail in the foregoing description and drawings, it will be understood by those skilled in the art that variations and modifications thereof can be made without departing from the spirit and scope of the invention as set forth in the following claims.

What is claimed is:

1. A support assembly for supporting a manufactured home having first and second aligned sections, with each section including an external and an internal support joist for supporting the manufactured home above a ground surface, said support assembly including:

first and second outer upright piers, said first outer upright pier having an upper end adapted to support an external support joist of the first aligned section and a lower end adapted to be placed adjacent the ground surface, said second outer upright pier having an upper end adapted to support an external support joist of the second aligned section and a lower end adapted to be placed adjacent the ground surface;

first and second inner upright piers, said first inner upright pier having an upper end adapted to support an internal support joist of the first aligned section and a lower end adapted to be placed adjacent the ground surface, said second inner upright pier having an upper end adapted to support an internal support joist of the second aligned section and a lower end adapted to be placed adjacent the ground surface;

at least one support platform positioned beneath said lower end of each pier;

first and second tie down anchors adapted to be anchored in the ground, said first tie down anchor positioned outside of said first outer upright pier, and said second tie down anchor positioned outside of said second outer upright pier;

first and second anchor ties, said first anchor tie having first and second ends and being connected at its first end to said first tie down anchor and adapted to extend at an upward incline from said first tie down anchor and over the external support joist of the first aligned section and downwardly therefrom to connect at its second end to said at least one support platform positioned beneath said first outer upright pier, said second anchor tie having first and second ends and being connected at its first end to said second tie down anchor and adapted to extend at an upward incline from said second tie down anchor and over the external support joist of the second aligned section and downwardly therefrom to connect at its second end to said at least one support platform positioned beneath said second outer upright pier;

first and second rectilinear compression members, said first rectilinear compression member extending laterally between said first tie down anchor and said lower end of said first outer upright pier and arranged to resist movement of said first tie down anchor toward said first outer upright pier, said second rectilinear compression member extending laterally between said second tie down anchor and said lower end of said second outer pier and arranged to resist movement of said second tie down anchor toward said second outer upright pier; and first and second cross ties, said first cross tie having first and second ends and being connected at its first end at said lower end of said first inner upright pier and adapted to extend at an upward incline and over the support joist of the second aligned section and downwardly therefrom to connect at its second end to said at least one support platform positioned beneath said lower end of said second inner upright pier, said second cross tie having a first and second end and being connected at its first end at said lower end of said second inner upright pier and adapted to extend at an upward incline and over the internal support joist of the first aligned section and downwardly therefrom to connect at its second end to said at least one support platform positioned beneath said lower end of said first inner upright pier.

2. A support assembly of claim 1 further comprising a rectilinear lateral compression member extending along the ground surface between and abutting each of said inner upright piers.

3. The support assembly of claim 1 further comprising a rectilinear lateral compression member extending along the ground surface and abutting each outer upright pier and an adjacent inner upright pier.

4. A support assembly for supporting a manufactured home during winds of less than about 80 MPH, the manufactured home including first and second support joists for supporting the manufactured home above a ground surface, said support assembly including:

first and second upright piers, said first upright pier having an upper end adapted to support the first support joist and a lower end adapted to be placed adjacent the ground surface, said second upright pier having an upper end adapted to support the second support joist and a lower end adapted to be placed adjacent the ground surface;

at least one support platform positioned beneath said lower end of each pier;

a rectilinear central compression member extending laterally between said lower ends of said piers and arranged to transmit wind force exerted on said first upright pier to said second upright pier and vice versa; and first and second cross ties, said first cross tie having first and second ends and being connected at its first end at said lower end of said first pier and adapted to extend at an upward incline and over the second support joist and downwardly therefrom to connect at its second end to said at least one support platform positioned beneath said second upright pier, and a second cross tie having first and second ends and being connected at its first end at said lower end of said second upright pier and adapted to extend at an upward incline and over the first support joist and downwardly therefrom to connect at its second end to said at least one support platform positioned beneath said first upright pier.

5. The support assembly of claim 4, further including a second support platform positioned beneath each of said upright piers, wherein said first end of said first cross tie is connected to a tie link mounted to said second support platform positioned beneath said first upright pier and said first end of said second cross tie is connected to a tie link mounted to said second support platform positioned beneath said second upright pier.

6. The support assembly of claim 5, wherein said second end of said first cross tie is connected to a first tension link mounted to said at least one support platform positioned beneath said second pier, and a second end of said second cross tie is connected to a second tension link mounted to said at least one support platform positioned beneath said first pier.

7. A support assembly for supporting a manufactured home having first and second elongated home sections having lengths arranged in side-by-side abutment and including an inner and an outer support joist positioned beneath each of the elongated home sections for supporting the manufactured home above a ground surface, said support assembly including:

groups of piers adapted to be positioned at intervals along the lengths of the home sections, with each group of piers including a first inner pier adapted to support the inner support joist positioned beneath the first elongated home section and a second inner pier adapted to support the inner support joist positioned beneath the second elongated home section;

at least one support platform positioned beneath a lower end of each inner pier;

a compression member extending laterally between and in a compressive relationship with said lower ends of said first inner pier and said second inner pier; and first and second cross ties, said first cross tie having first and second ends and being connected at its first end at said lower end of said first inner pier and adapted to extend at an upward incline and over the inner joist positioned beneath the second elongated home section to connect to at its second end to said at least one support platform positioned beneath said lower end of said second inner pier, and a second cross tie having first and second ends and being connected at its first end at said lower end of said second inner pier and adapted to extend at an upward incline and over the inner joist positioned beneath the first elongated home section to connect at its second end to said at least one support platform positioned beneath said lower end of said first inner pier.

8. The support assembly of claim 7, wherein said compression member is a rectilinear central compression member which is adapted to extend along the ground surface.

9. The support assembly of claim 7, wherein said groups of piers further includes a first outer pier adapted to support the outer support joist positioned beneath the first elongated home section and a second outer pier adapted to support the outer support joist positioned beneath the second elongated home section.

10. The support assembly of claim 9, further comprising a first tie down anchor adapted to be anchored in the ground outside of said first outer pier, a second tie down anchor adapted to be anchored in the ground outside of said second outer pier, and first and second anchor ties, said first anchor tie having first and second ends and being connected at its first end to said first tie down anchor and adapted to connect at its second end to the outer support joist positioned beneath the first elongated home section, said second anchor tie having first and second ends and being connected at its first end to said second tie down anchor and adapted to connect at its second end to the outer support joist positioned beneath the second elongated home section.

11. The support assembly of claim 7, further including a second support platform positioned beneath each of said inner piers, wherein said first end of said first cross tie is connected to a tension link mounted to said second support platform positioned beneath said first inner pier and said first end of said second cross tie is connected to a tension link mounted to said second support platform positioned beneath said second inner pier.

12. The support assembly of claim 11, wherein said second end of said first cross tie is connected to a tie link mounted to said at least one support platform positioned beneath said second inner pier and said second end of said second cross tie is connected to a second tie link mounted to said at least one support platform positioned beneath said first inner pier.

13. A support assembly for supporting a premanufactured building above a ground surface, the building including horizontally extending parallel first and second support joists positioned above the ground surface, the support assembly comprising:

first and second support columns, each support column having a lower end portion for placement adjacent the ground surface and being adapted to be supported by the ground surface, with said first support column adapted to be upwardly from the ground surface for supporting the first support joist and said second support column adapted to be upwardly from the ground surface for supporting the second support joist, said support columns being aligned with each other for extending across the lengths of said support joists;

first and second elongated cross ties, each cross tie having opposed first and second ends;

said first cross tie connected at its first end to said lower end portion of said first support column and adapted to extend over the second support joist of the building and connected at its second end to said lower end portion of said second support column; and said second cross tie connected at its first end to said lower end portion of said second support column and adapted to extend over the first support joist of the building and connected at its second end to said lower end portion of said first support column.

14. The support assembly of claim 13, and wherein said lower end portion of each support column includes at least one support platform.

15. The support assembly of claim 13, and wherein each of said support columns includes a pier.

16. The support assembly of claim 15, and further including:

a compression member extending between said piers and being held therebetween in compression.

* * * * *